United States Patent [19]

Domo

[11] 4,236,332

[45] Dec. 2, 1980

[54] MEDICAL HISTORY CARD

[75] Inventor: John M. Domo, Cleveland, Ohio

[73] Assignee: Melchior P. Beller, Lakewood, Ohio

[21] Appl. No.: 974,331

[22] Filed: Dec. 29, 1978

[51] Int. Cl.[3] ..... G09F 3/02

[52] U.S. Cl. ..... 40/2.2; 40/158 B; 283/7; 283/8 R

[58] Field of Search ..... 40/2.2, 159, 158 B, 40/361, 405; 283/7, 8, 9, 11

[56] References Cited

U.S. PATENT DOCUMENTS

| | | | |
|---|---|---|---|
| 3,180,042 | 4/1965 | Destal | 283/7 X |
| 3,555,713 | 1/1971 | Leinbach | 40/159 X |
| 3,792,542 | 2/1974 | Cohan | 40/158 B |
| 3,810,566 | 5/1974 | Adams et al. | 40/158 B X |
| 3,921,318 | 11/1975 | Calavetta | 40/158 B X |
| 3,959,907 | 6/1976 | Anderson | 40/159 |
| 4,156,539 | 5/1979 | Davidson et al. | 283/7 |

*Primary Examiner*—John F. Pitrelli
*Assistant Examiner*—G. Lee Skillington
*Attorney, Agent, or Firm*—Shlesinger, Arkwright, Garvey and Dinsmore

[57] ABSTRACT

A medical record card wherein a supporting card contains a microfilm portion having indicia visible to the human eye coded for particular chronic conditions which effect emergency treatment and having indicia visible by use of a microfilm reader which detail the medical history and identification data of the patient. The supporting card contains the code for the indicia which alert medical personnel to chronic conditions and, in addition, contains some important identification data about the patient and about the type and use of the medical record card.

2 Claims, 7 Drawing Figures

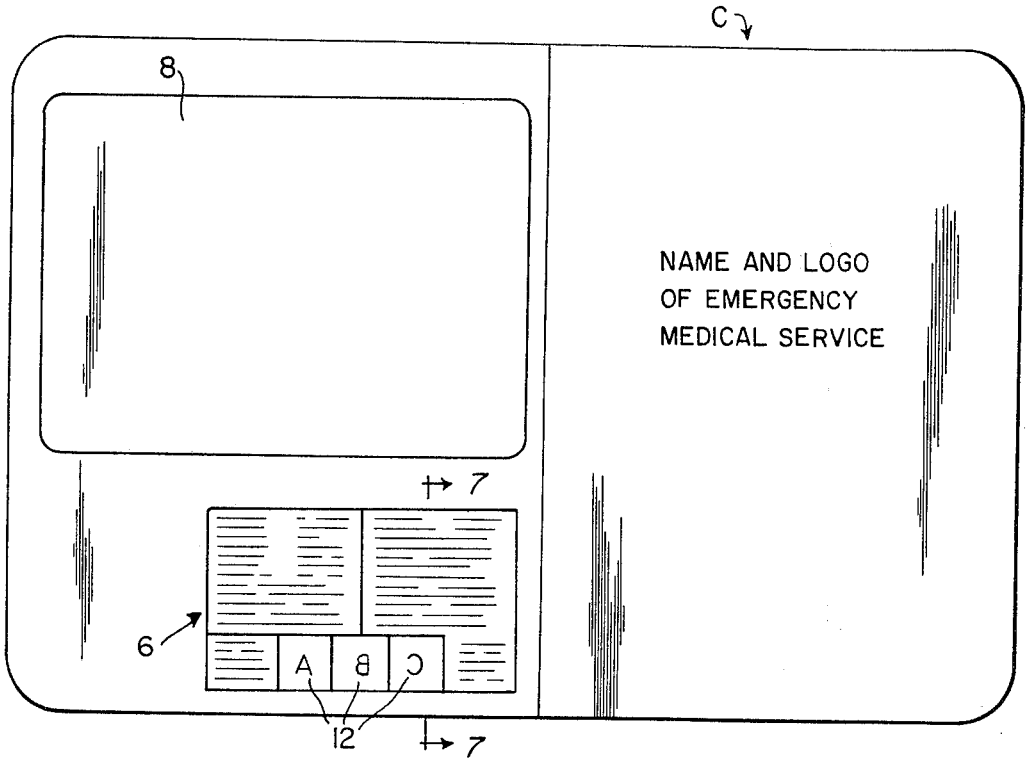
FIG. 4
FIG. 5
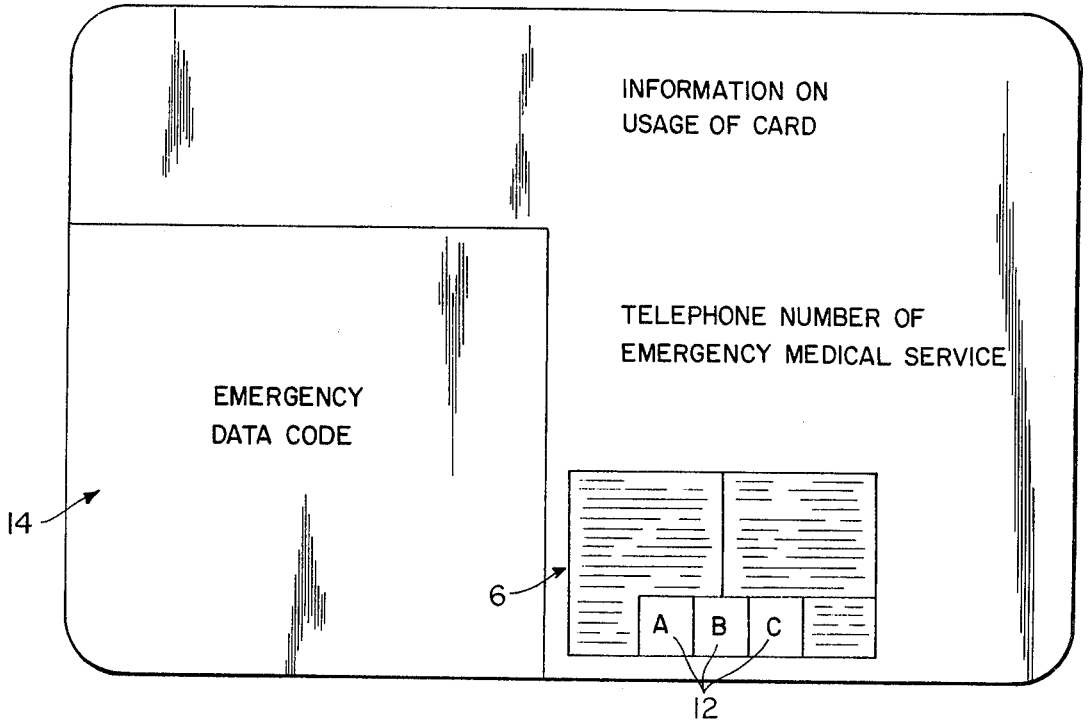

MEDICAL HISTORY CARD

BACKGROUND AND FIELD OF INVENTION

The present invention pertains to medical record cards which provide personal medical information about a patient in times of medical emergency. At times of medical emergency, it is critically important for medical personnel to gain immediate access to a patient's medical file history. Medical history pertaining to allergies, chronic diseases and blood conditions must often be learned before any treatment can begin so that no treatment will be initiated which would have a deleterious effect due to a presently existing chronic condition of the patient. This information must often be gained without the help of the patient and is therefore difficult to obtain quickly when only the identification of the patient can be ascertained from a driver's license or similar identification. To alleviate this problem, medallions and bracelets have been worn by persons suffering from particular conditions such as diabetes, hemophilia and antibiotic allergies. However, a need exists to provide a means for more adequately and thoroughly describing a person's medical history on a device which can be easily carried by all individuals.

Attempts to provide such a device have included those shown in U.S. Pat. Nos. 3,921,318 to Calavetta, 3,758,970 to Annenberg and 3,750,315 to Anderson.

None of these prior art devices discloses a device which adequately displays the important medical history of an individual in a manner which is sufficiently easy to be read and used by medical personnel and which is sufficiently adaptable to production.

OBJECTS AND SUMMARY OF THE INVENTION

Therefore one object of the present invention is to provide a medical record card which contains and displays the identification and medical history data of an individual patient.

Another object of the present invention is to provide a medical record card which alerts medical personnel to particular chronic diseases, blood conditions and allergies of a patient.

Still another object of the present invention is to provide a medical record card which contains a microfilm portion on which is contained the medical history of a patient.

A further object of the present invention is to provide a medical record card which contains a microfilm portion containing indicia which are visible to the human eye for alerting medical personnel to the most critical data.

A further object of the present invention is to provide a medical record card which contains a microfilm portion which can be read on a microfilm reader, an X-ray reader, a low powered microscope or a hand held viewer and which contains extensive medical history and identification information of a patient.

Another object of the present invention is to provide a medical record card which is easily carried in the wallet of the patient.

A still further object of the present invention is to provide a medical record card wherein all of the medical history data and detailed identification data is contained on a microfilm portion and the most important and immediately needed identifying data is typed onto the card.

Still another object of the present invention is to provide a medical record card which is a durable laminated card wherein the lamination binds the microfilm portion to the supporting card.

These and further objects of the present invention are accomplished by a medical record card wherein a supporting paper-like or Mylar or the like card contains a microfilm portion having indicia visible to the human eye coded for particular chronic conditions which effect emergency treatment and having indicia visible by use of a microfilm reader in order to maintain a certain confidentiality which detail the medical history and identification data of the patient. The supporting card contains the code for the indicia which alert medical personnel of chronic conditions and, in addition, contains some important identification about the patient and about the type and use of the medical record card.

DESCRIPTION OF THE DRAWINGS

FIG. 4 is an enlarged top plan view of the medical record card.

FIG. 5 is an enlarged bottom plan view of the medical record card.

DESCRIPTION OF THE INVENTION

Figure 1:
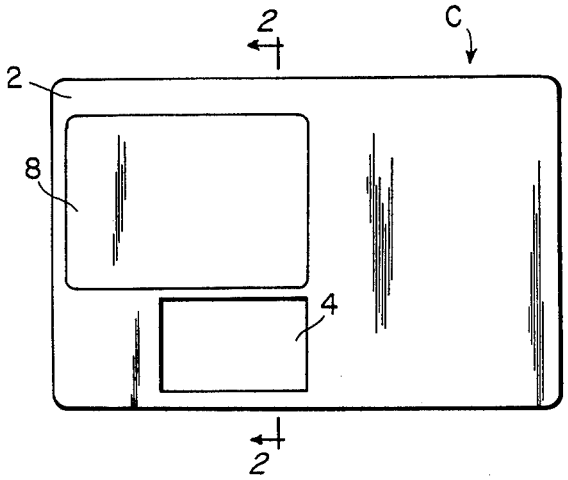
FIG. 1 is a top plan view of the medical record card.
Figure 2:
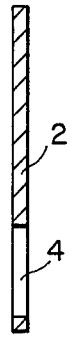
FIG. 2 is a cross-sectional view through 2—2 of FIG. 1.
Figure 3:
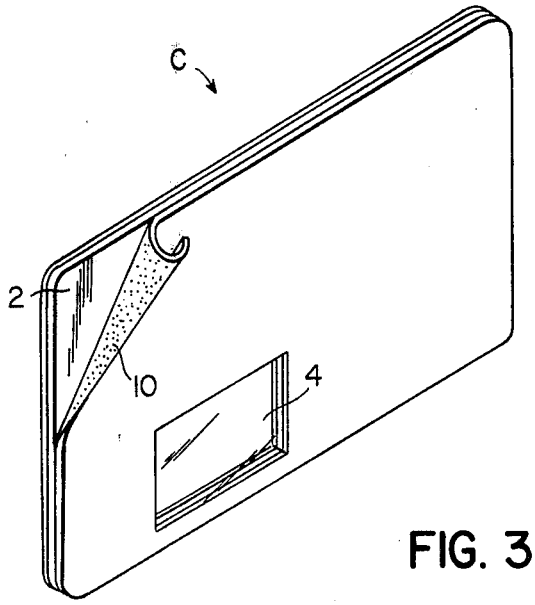
FIG. 3 is a perspective view of the medical record card showing a portion of the front lamination peeled away.
Figure 7:
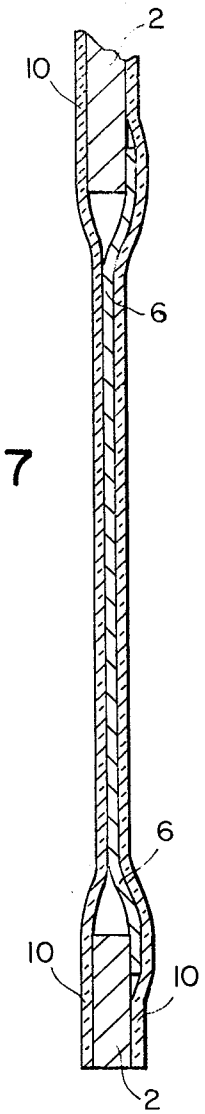
FIG. 7 is an enlarged cross-sectional view through 7—7 of FIG. 4.

The medical record card of the present invention is shown in its actual size in FIG. 1 as viewed from the front side of the card. With reference to FIGS. 1 and 4, the paper card 2 contains window 4 as a cut out portion to contain the microfilm piece 6 while the printable portion 8 of the medical record card C will contain identification data for the individual patient. With the microfilm piece 6 placed within the window 4, and the appropriate information on the printable portion 8, medical record card C is laminated with a clear plastic coating 10, as shown in FIGS. 3 and 7. Lamination of the card serves to protect the card and to bind together the microfilm piece 4 and paper card 2 forming a card with a smooth outside surface. To properly place the microfilm piece 6 within the window 4, the microfilm may be either cut shorter than the window and secured in place by the laminated coating 10, or the microfilm may be cut longer than the window 4, overlap onto the paper card 2, and then be secured by the laminated coating 10 as shown in FIG. 7.

Since the medical record card C is to be carried by an individual in order to provide medical history to emergency medical personnel at times when the individual may not be capable of conversation, it is desirable to provide the card C with some easily recognizable general identification information. For this reason, general identification information such as name, social security number and type of medical card is typed onto the paper card 2 in the printable portion 8. While the general identification data is provided on the printable portion 8, the microfilm piece 6 provides the detailed identification data as well as the medical history data.

Figure 6:
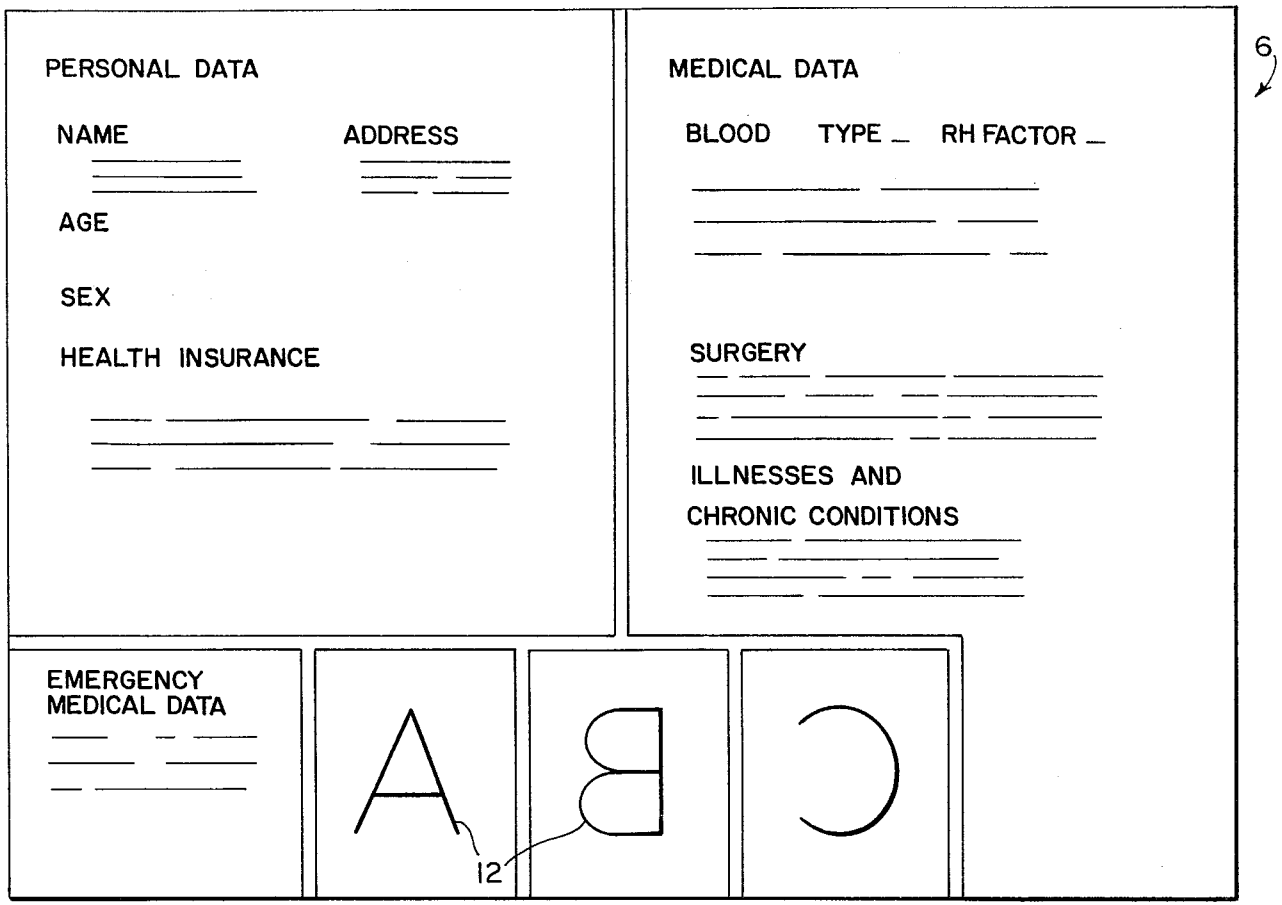
FIG. 6 is an enlarged top plan view of the microfilm portion of the medical record card.

FIG. 6 is an enlarged view of the microfilm piece 6 and shows the general arrangement of the detailed identification medical history data. For example purposes, FIG. 6 shows the detailed personal identification data presented in the left hand column and would contain such items as name, address, age, spouse's name, emergency phone numbers, health insurance policy information, and family doctor's name. By further example, the detailed medical history is presented in the right hand column in FIG. 6 and would include such items as illnesses and chronic conditions, allergies, important past surgeries, vaccinations, immunizations and blood type. This detailed information is prepared on the microfilm, so that in its final form the detailed information is viewable through a microfilm reader from the front side of the card on which the general identification data is printed. In addition to the detailed medical and identification data, the microfilm piece 6 further contains a series of visible letters 12 letters A through O which are viewable from the backside of the card and which are readable by the human eye without the aid of a magnification reader. These visible letters 12 are coded to correspond to an emergency data section 14, also readable from the backside of the card C, which is printed onto the paper card 2 and details the chronic conditions which are coded for by the visible letters 12. The chronic conditions there encoded would be chronic conditions such as diabetes, hemophilia, allergies to antibiotics and the like which are particularly important for medical personnel to be aware of before beginning treatment of an emergency patient. This emergency data may further be provided on the microfilm piece 6 in letters viewable through a magnification reader. However, it is an important feature of this invention that these types of emergency chronic conditions are coded onto the microfilm piece with the explanation of the code printed onto the paper card 2. Because of this, the medical record card C can be prepared in a manner superior to any of the prior art inventions, in that, all medical data including emergency data is prepared on the microfilm piece 6 in one central preparation location. This manner of preparation reduces the possibility of medical recording errors while creating a manufacturing process which is more consistent and less expensive.

Finally, medical record card C contains on its backside certain imformation which my be useful in the use of the card. As shown in FIG. 5, the backside of the card C also contains information telling the user how and on which machine to read the card and it further tells the user how to contact the medical record card supplier.

While this invention has been described as having a preferred design, it will be understood that it is capable of further modification. This application, is, therefore, intended to cover any variations, uses, or adaptations of the invention following the general principles thereof and including such departures from the present disclosure as come within known or customary practice in the art to which this invention pertains, and as may be applied to the essential features hereinbefore set forth and fall within the scope of this invention or the limits of the claims.

What I claim is:

1. A wallet size medical record card to be carried on the person of an individual, comprising:

(a) a card having a window therethrough with microfilm positioned in said window and a transparent plastic material laminated to said card and said microfilm;

(b) an identification data portion on said card comprising data identifying the individual carrying said card;

(c) an emergency data code portion on said card including a list of medical conditions, each said medical condition having listed therewith an indicium for indicating said medical condition;

(d) a first data portion on said microfilm readable by the human eye without magnification means and a second data portion on said microfilm readable by the human eye only with magnification means;

(e) said second data portion including a medical history of the individual carrying said card and said first data portion comprising those of said indicia of said emergency data code portion corresponding to those of said list of medical conditions which the individual carrying said card has whereby in a medical emergency those of said list of medical conditions which the individual has can be read on said microfilm without the need to magnify the data on said microfilm.

2. A medical record card as in claim 1 and wherein:

(a) said card has a front and a back side;

(b) said identification data portion being visible from said front side of said card;

(c) said second data portion on said microfilm being readable from said front side of said card;

(d) said first data portion on said microfilm being readable from said back side of said card; and (e) said emergency data code portion being readable from said back side of said card.

* * * * *